US011498302B2

(12) United States Patent
Kirch

(10) Patent No.: US 11,498,302 B2
(45) Date of Patent: Nov. 15, 2022

(54) PRESS DRIVE WITH ENERGY RECOVERY

(71) Applicants: MOOG GmbH, Boeblingen (DE); Laura Veturica, Aachen (DE)

(72) Inventor: Klaus Kirch, Aachen (DE)

(73) Assignee: Moog GmbH, Boeblingen (DE)

( * ) Notice: Subject to any disclaimer, the term of this patent is extended or adjusted under 35 U.S.C. 154(b) by 0 days.

(21) Appl. No.: 17/042,292

(22) PCT Filed: Mar. 14, 2019

(86) PCT No.: PCT/EP2019/056421

§ 371 (c)(1),
(2) Date: Sep. 28, 2020

(87) PCT Pub. No.: WO2019/185362

PCT Pub. Date: Oct. 3, 2019

(65) Prior Publication Data

US 2021/0114325 A1 Apr. 22, 2021

(30) Foreign Application Priority Data

Mar. 27, 2018 (DE) ..... 10 2018 107 245.7

(51) Int. Cl.
*B30B 15/16* (2006.01)
*F15B 21/14* (2006.01)

(52) U.S. Cl.
CPC ..... *B30B 15/16* (2013.01); *B30B 15/166* (2013.01); *F15B 21/14* (2013.01); *F15B 2211/20515* (2013.01); *F15B 2211/20561* (2013.01)

(58) Field of Classification Search
CPC ..... B30B 15/16; B30B 15/161; B30B 15/163; B30B 15/165; B30B 15/166;
(Continued)

(56) References Cited

U.S. PATENT DOCUMENTS 5,499,525 A * 3/1996 Kordak ..... B21D 24/08 72/453.03
7,000,446 B2 * 2/2006 Nieschulz ..... B21D 24/08 72/350
8,037,735 B2 * 10/2011 Kohno ..... B21D 24/08 72/453.13
8,429,946 B2 * 4/2013 Maeda ..... B21D 22/26 72/350
(Continued)

FOREIGN PATENT DOCUMENTS

CN 102363375 A 2/2012
DE 102009049847 A1 4/2011
(Continued)

OTHER PUBLICATIONS

European Patent Office (ISA/EP), International Search Report and Written Opinion of the ISA in International Patent Application No. PCT/EP2019/056421, dated Oct. 3, 2019.

*Primary Examiner* — Dustin T Nguyen
(74) *Attorney, Agent, or Firm* — Harter Secrest & Emery LLP

(57) ABSTRACT

An electro-hydrostatic actuator system for a press drive, having an upper piston with a press surface, which acts from a first direction, wherein the press surface of the upper piston is actuated by means of a piston rod in a hydraulic cylinder of the upper piston and traverses a first distance in a press run, and a first electro-hydrostatic actuator for driving the upper piston, comprising a first pump and a first motor generators which is controlled by a first controller. The system furthermore comprises at least one auxiliary piston with a press surface, which acts from a second direction opposite the first direction, wherein the press surface of the auxiliary piston is actuated by means of a piston rod in a hydraulic cylinder of the auxiliary piston and traverses a second distance in the press run, and a second electro-hydrostatic actuator for driving the at least one auxiliary piston, comprising a second pump and a second motor generator which is controlled by a second controller. The second motor generator is operated as a generator in the
(Continued)

Figure 1:
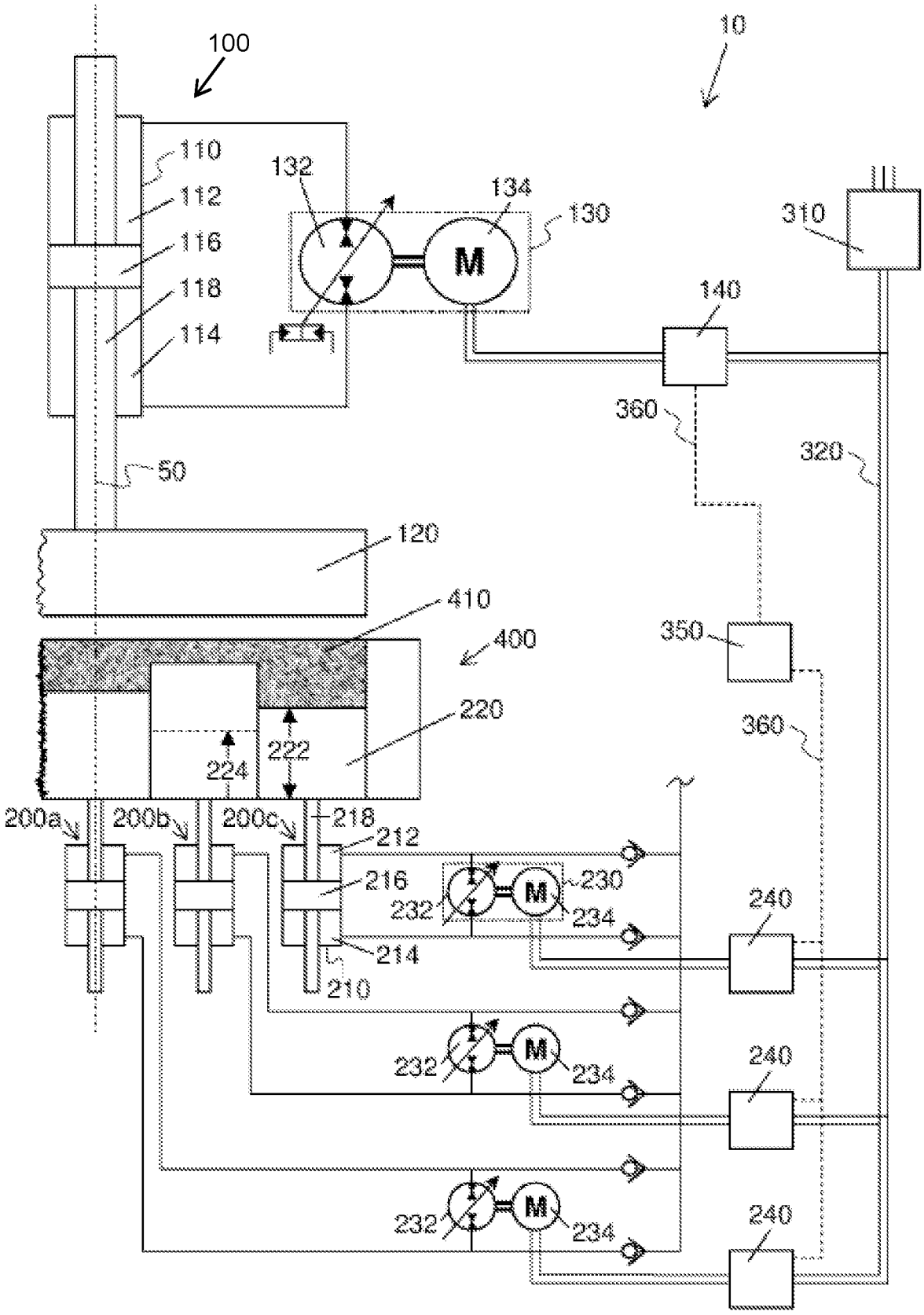

press run, thereby generating energy which is provided to the first motor generator or auxiliary piston, which are operated as motors, via the common DC bus.

20 Claims, 2 Drawing Sheets

(58) Field of Classification Search
CPC ..... B30B 15/168; F15B 2211/20515; F15B 2211/27; F15B 2211/20561; F15B 2211/20576; F15B 2211/88; F15B 21/14; B21D 24/02; B21D 24/14; B21D 24/08
See application file for complete search history.

(56) References Cited

U.S. PATENT DOCUMENTS

| | | | | |
|---|---|---|---|---|
| 9,346,095 | B2 * | 5/2016 | Knoche | B21D 24/02 |
| 2009/0071218 | A1 | 3/2009 | Kohno et al. | |
| 2015/0056315 | A1 | 2/2015 | Pannewtiz et al. | |
| 2015/0158262 | A1 * | 6/2015 | Graf | F15B 21/14 100/35 |
| 2019/0232353 | A1 * | 8/2019 | Kohno | B30B 1/265 |

FOREIGN PATENT DOCUMENTS

| | | | |
|---|---|---|---|
| DE | 102013005876 | A1 | 10/2014 |
| DE | 102017004803 | A1 | 11/2018 |
| EP | 2077167 | A2 | 7/2009 |
| JP | 2010234379 | A | 10/2010 |
| WO | 2012008932 | A1 | 1/2012 |

* cited by examiner

PRESS DRIVE WITH ENERGY RECOVERY

The present invention relates to a press drive as used, for example, in powder presses. Powder presses are used for the production of special, highly precise workpieces, for example of various types of toothed wheels, motor connecting rods, supporting elements and other parts. Frequently, the workpieces thus produced are exposed to high loads so that they must satisfy high quality requirements; for example, they must be absolutely free of cracks. Powder presses produce a powder blank which has to fulfill the stated conditions and is then usually further processed, sintered.

Press drives are known in the prior art. They are generally implemented as hydraulic machines because very high forces, for example in the range from 200 kN to more than 25,000 kN, are used. In such presses, the powder filled into the tool is compressed by an upper piston and, as a counterforce, by auxiliary pistons. During the pressing process, the auxiliary pistons execute movements relative to the upper piston movement so that the powder is compressed homogeneously from the top and the bottom so that a powder blank of high quality, in particular a crack-free powder blank, is produced as a result.

During the pressing process, the movements of the auxiliary pistons in the press are carried out via hydraulic cylinders with continuous valves. In the movement, the auxiliary pistons generate a counterforce against the upper piston, which counterforce compresses the powder uniformly in the different planes via the upper piston compression stroke. The aim is to achieve the end position of all auxiliary pistons simultaneously. Since a uniform compression of the powder via the upper piston compression stroke is desired for all planes, auxiliary pistons partially travel longer strokes (effective compression stroke) than would be necessary for the actual powder compression of this plane. For this reason, compression strokes of the auxiliary pistons and/or the upper pistons may increase, which increases the energy consumption of the press. The movements of the auxiliary pistons take place, for example, via hydraulic continuous valves which have to apply the additionally required energy to overcome the effective pressing path. The hydraulic systems supplying these presses are complex, require a correspondingly large installation space, have a large volume of oil, are noisy and energy-inefficient. In particular, the lower energy efficiency is caused by the auxiliary pistons, which are moved by the upper piston, throttling the amount of oil which has accumulated through the pressing path, into a tank. In hydraulic systems, this energy loss must be removed again from the oil as heat via cooling systems which likewise consume energy.

Based on this prior art, it is an object of the present invention to at least partially overcome or improve upon the disadvantages of the prior art. The object is achieved with a device according to claim 1. Preferred embodiments and modifications are the subject matter of the subclaims.

An electro-hydrostatic actuator system according to the invention for a press drive has an upper piston with a press surface acting from a first direction, wherein the press surface of the upper piston is actuated by means of a piston rod in a hydraulic cylinder of the upper piston and traverses a first distance in a press run. This serves to compress a pressed material in a mold from a first direction. The actuator system has a first electro-hydrostatic actuator for driving the upper piston, comprising a first pump and a first motor generator, which is controlled by a first controller.

The system furthermore comprises at least one auxiliary piston having a press surface acting from a second direction opposite the first direction, wherein the press surface of the auxiliary piston is actuated by means of a piston rod in a hydraulic cylinder of the auxiliary piston and traverses a second distance in the press run. The system has a second electro-hydrostatic actuator for driving the at least one auxiliary piston, comprising a second pump and a second motor generator, which is controlled by a second controller.

The electro-hydrostatic actuator system is characterized in that the second motor generator of the second electro-hydrostatic actuator is operated as a generator in the press run.

The term "upper piston" used herein could lead to the assumption that this part of a press according to the invention is arranged at the top and that the auxiliary piston or pistons are arranged at the bottom. This may be the case in some embodiments; in the following, however, this term also describes embodiments in which the "upper piston" is arranged at the bottom or laterally at any angle. The terms "top" and "bottom" are also to be understood hereinafter in this sense.

A system according to the invention may have only a single auxiliary piston. Preferably, a system comprises a plurality of auxiliary pistons. The auxiliary piston or pistons also need not necessarily be arranged exactly in the opposite direction to the upper piston but may in some embodiments also be arranged at angles other than 180° to the effective direction of the upper piston. In one embodiment, the arrangement may also be reversed, i.e., the second electro-hydrostatic actuator may be a motor, and the first electro-hydrostatic actuator may be a generator.

An actuator system according to the invention has a plurality of auxiliary pistons, in particular when the system is used for producing complex powder blanks. This has the advantage that each part of the complex powder blank to be specifically produced can be assigned to an auxiliary piston and each part can thus be produced with a specific, desired material characteristic and/or material distribution. In this way, the mentioned assignment, for example in the case of a toothed wheel, makes it possible for the teeth arranged outside to be compressed more strongly, i.e., more highly, and for the inner parts to be compressed more weakly, i.e., less. In this way, in the case of the same powder blank, a particularly high strength of the teeth is achieved and at the same time a lower weight of the internally arranged parts of the toothed wheel. Despite these different characteristics of the different parts of the toothed wheel, production in an actuator system according to the invention ensures that this toothed wheel is produced in high quality, i.e., in particular crack-free. This is advantageous not only for toothed wheels but for a plurality of types of high-quality powder blanks.

In some embodiments of powder presses according to the invention, the powder filled into the tool is compressed by an upper piston and, as a counterforce, by one or more movable auxiliary pistons in the electro-hydrostatic devices. The devices consist, at least in some embodiments, of a plurality of planes that are moved by the auxiliary pistons. In these embodiments, the auxiliary pistons are sometimes also referred to as auxiliary axles. During the pressing process, these planes of the electro-hydrostatic devices execute movements relative to the movement of the upper pistons so that the powder is compressed homogeneously from the top and the bottom and a crack-free powder blank is thus produced.

In the electro-hydrostatic actuator system according to the invention, which is used both in the upper piston and in the auxiliary pistons, only as much energy is taken from the grid as is required for compressing the powder. The energy for the relative movements of the auxiliary pistons therefore does not have to be taken from the supply grid, but energy is even partially returned to the supply grid during the press run. This advantageously leads to a reduction in the energy requirement of a system according to the invention compared to the prior art. It should be noted that in real systems having an efficiency of less than 100%, it is necessary to supply energy from the supply grid in order to compensate for these losses.

Furthermore, the cooling requirement of this electro-hydrostatic system is significantly lower than in the prior art; in some embodiments, the need for a special cooling system is even eliminated. Thus, not only is the energy demand further reduced by this invention, but the systems can also become simpler and more cost-effective, in particular because of the smaller dimensioned cooling system.

By the combined effect of said advantages, when using a system according to the invention, the required work or energy per produced powder blank can be substantially reduced in comparison with systems in the prior art, and the costs per produced piece can thus be reduced. Moreover, the installation space, the amount of oil and the noise can be considerably reduced compared to conventional powder presses with conventional hydraulic drives.

In some embodiments of an actuator system according to the invention, the second distance of the second press surface is a function of the first distance of the first press surface and the second distance in the first direction is shorter than the first distance.

Thus, in the press run, the upper piston is moved in a first direction, in particular lowered, wherein the press surface of the upper piston is actuated by means of a piston rod in a hydraulic cylinder of the upper piston. In this case, the press surface traverses a first distance, for example on a length of 20 mm, for example in a linear movement. The press surface can in this case in particular act on the upper part of a mold which contains a pressed material (e.g., powder). One or more auxiliary pistons are movably arranged on the lower part of the mold so that the pressed material and at the same time the auxiliary piston or pistons are displaced downward by the movement of the press surface. The auxiliary pistons thereby traverse a second distance. In order for the pressed material to be compressed, the second distance in the first direction is shorter than the first distance; this second distance is thus shorter than 20 mm in this example. The second distance may even be negative, i.e., there may be auxiliary pistons moving upward during the press run.

The second distance of the second press surface may be a function of the first distance of the first press surface. For example, there may be a linear dependency between the second and the first distance, in particular if the inner structure of the powder blanks is to be particularly homogeneous. Other functions are also possible. For example, a polynomial function may be selected. A function which is defined by interpolation of supporting points may also be selected, for example to generate a predetermined breaking point for a special component. In this way, it is also possible to form a powder blank whose core is lighter, or even heavier, than its edge regions. In addition, the function for the different auxiliary pistons may be different in order to implement a different weight distribution at different points, such as in the case of a motor connecting rod.

The fact that the second motor generator of the second electro-hydrostatic actuator is operated as a generator in the press run therefore does not mean that said second motor generator is operated as a generator for each type of powder blank during every phase of production. Rather, at least in the case of certain types of powder blanks to be produced, the second motor generator may be operated as a motor in a certain phase of the production. This is the case, in particular, when a particularly high compression of the powder blank or of a part of the powder blank is desired. In an embodiment according to the invention, it is therefore also possible for most auxiliary pistons to be operated as a generator, but for at least one of the motor generators of the auxiliary pistons to be operated as a motor. In one embodiment according to the invention, both variants may also be combined, i.e., at least one of the motor generators may be operated as a motor during the entire press run and another at least in a phased manner. In an actuator system according to the invention, the energy integrated over all phases of all motor generators of the auxiliary pistons is negative, i.e., the second motor generator of the second electro-hydrostatic actuator (or a plurality thereof) is operated as a generator.

In some embodiments, at least one of the press surfaces of the auxiliary pistons has a different thickness than another press surface and/or at least one of the press surfaces has a different resting distance than another press surface.

In an embodiment having a plurality of auxiliary pistons, it may be desired that a portion of the produced powder blank has a smaller thickness than another portion. This can be achieved in that at least one of the press surfaces of the auxiliary pistons has a different thickness than another press surface. However, the different thickness of the powder blank produced may also be achieved in that, for example given identical thickness of the press surfaces of the auxiliary pistons, one of the press surfaces has a different resting distance than another press surface, i.e., the "starting position" of the auxiliary pistons may have a different offset from a base line. It is also possible to combine both measures.

In some embodiments, the system has a plurality of upper pistons. This has the advantage that the flexibility of the system is increased even further so that, for example, even more complex powder blanks can be produced with very high quality.

In some embodiments, the upper piston or pistons are designed as electro-hydrostatic actuators. This has the advantage that the system can be made more homogeneous. For example, a system with a lower space requirement can thus be set up or produced and/or the control options can be expanded.

In some embodiments, the first controller assigned to the first motor generator has a first control characteristic and the second controller assigned to the second motor generator has a second control characteristic.

In one of these embodiments, both control characteristics may be linear, or, in the case of a plurality of auxiliary pistons and/or a plurality of upper pistons, all control characteristics may be linear. This has the advantage that the powder blanks produced are particularly homogeneous.

In other of these embodiments, different control characteristics may be assigned to the different electro-hydrostatic actuators. The control characteristics of the auxiliary pistons may have any dependencies, both on the workpiece and/or on the desired properties of the press blank in relation to the movement of the upper piston. In particular, the first control characteristic and/or the second control characteristic may be described linearly, polynomially or by supporting points. This diversity has the advantage that a multitude of functions which implement functions of the first distance of the first press surface as a function of the second distance of the second press surface can be implemented in a consistent and reproducible manner. This is supported in particular by the use of electro-hydrostatic actuators.

In one embodiment, the first control characteristic and/or the second control characteristic is determined by a central control unit. A central control unit advantageously enables, for example, a reaction to deviations in the pressing process and/or a functional coupling of the control characteristics between the auxiliary pistons and/or the upper pistons and/or both groups of pistons. The set-up times of the systems are also shortened thereby.

In some embodiments, the system furthermore comprises an electrical supply line to which the first controller and the second controller are connected so that, in the press run, the second controller feeds current into the supply line. The controllers are sometimes also referred to as "drives".

With such a supply line, which is implemented, for example, as a DC bus, a consistent electrical arrangement for feeding back the current generated by the second motor generators can be formed. In particular, the supply of power to the upper piston can thus be supported so that such a system has a lower overall current requirement, i.e., less current is taken from the grid.

In an actuator system according to the invention, the energy generated by the "passive" relative movement of the auxiliary axles can thus be returned to the upper piston, which drives this "passive" relative movement of the auxiliary pistons. If the auxiliary axles are displaced by the upper piston during the relative movement in the press run, they operate as a generator. The energy obtained by the generator operation can be fed back via the controllers into the DC bus shared by the upper piston and the auxiliary pistons or into the grid. This fed-back energy can be used for the drive power of the upper piston drive. Feeding into the DC bus of the drives shared by the upper piston and the auxiliary axles should be preferred for reasons of better efficiency.

In some embodiments, the actuator system furthermore has a rapid traverse, wherein the second motor generator of the second electro-hydrostatic actuator is operated as a motor. All functions required for operating an electro-hydrostatic actuator system for a press drive can thus be implemented.

The invention is explained in the following on the basis of a preferred exemplary embodiment, wherein it is pointed out that this example encompasses modifications and/or additions as immediately evident to the person skilled in the art.

The following are shown:

FIG. 1: A schematic drawing of an exemplary embodiment of a system according to the invention.

Figure 2:
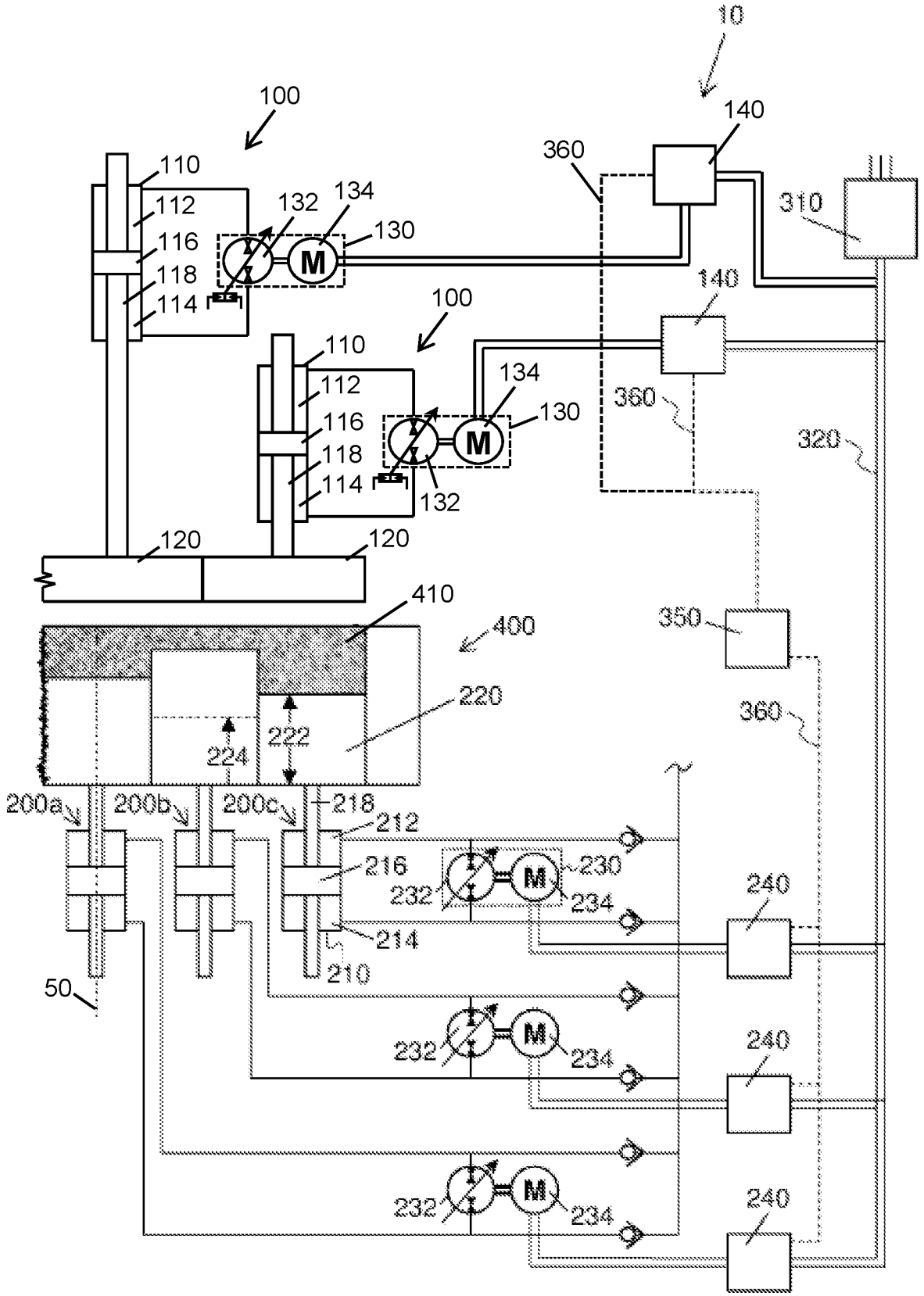

FIG. 1 shows an example embodiment of an electro-hydrostatic actuator system 10 according to the invention. In particular, the auxiliary pistons 200 and the press surface 120 of the upper piston 100 are shown only partially. The parts not shown are substantially symmetrical with respect to the line of symmetry 50. As shown in FIG. 2, in some embodiments, the system 10 has a plurality of upper pistons 100.

FIG. 2: A schematic drawing of another exemplary embodiment of a system according to the invention.

The powder press drive shown has an upper piston 100 and a plurality of auxiliary pistons 200*a*, 200*b*, 200*c*. Since the auxiliary pistons shown are constructed substantially identically, with the exception of the press surfaces 220, auxiliary pistons and their subcomponents are designated in the following with the same reference signs (e.g., 200*a*, 200*b*, 200*c*, 212, 216). Arranged between the upper piston 100 and the auxiliary pistons 200*a*, 200*b*, 200*c* is a mold 400 which contains a pressed material 410, e.g., powder. The upper piston 100 has a cylinder 110 comprising a first piston chamber 112 and a second piston chamber 114. The cylinder 110 is subjected to hydraulic pressure by a first electro-hydrostatic actuator 130 comprising a pump 132 and a motor generator 134. In the exemplary embodiment shown, the pump volume is variable; however, it is also possible to use a motor generator 134 having a variable speed or else a combination of both. The motor generator 134 is connected via the controller 140 of the upper piston to the electrical supply line 320 which, as shown here, may be designed as a DC bus. The DC bus 320 is supplied with energy via the power supply 310.

In the press run, the motor generator 134 acts, in motor function, on the first piston chamber 112. As a result, the piston 116 comprising the piston rod 118 is pressed downward and thus actuates the press surface 120 of the upper piston 100, which thus acts on the one hand on the pressed material 410 in the mold 400 and on the other hand displaces the press surfaces 220 of the auxiliary pistons 200*a*, 200*b*, 200*c*. The press surfaces 220 are connected to the piston rods 218 of the auxiliary pistons 200*a*, 200*b*, 200*c*. The pistons 216 in the cylinders 210 of the auxiliary pistons 200*a*, 200*b*, 200*c* thereby pressurize the second piston chambers 214 of the auxiliary pistons 200*a*, 200*b*, 200*c* so that the hydraulic fluid of the cylinders 210 actuates the pumps 232 of the second electro-hydrostatic actuators 230. The pumps 232 are connected to the motor generators 234. These motor generators 234 are operated as generators in the press run. The motor generators 234 can thus feed power to the DC bus 320 via the controllers 240 so that the current draw of the motor generator 134 of the upper piston 100 from the power supply 310 is reduced in the press run. The press surfaces 220 of the auxiliary pistons 200*a*, 200*b*, 200*c* have a different thickness 222 in order to be optimally adapted to the regions of the powder blank to be produced. However, as shown in the auxiliary piston 200*b*, the press surfaces 220 may also be spaced apart from a base line by a resting distance or offset 224 in the starting position. This can at least partially replace the different thickness 222 and thus enables further flexibilization in the use of the auxiliary pistons 200*a*, 200*b*, 200*c*.

In the embodiment described here, the press run (and also the rapid traverse) is controlled via the central control unit 350. These contain the control characteristics for the upper piston 100 and the auxiliary pistons 200*a*, 200*b*, 200*c* and thus control the controllers 140 and 240 via the control bus 360. This control bus 360 can be implemented, for example, as a field bus or also as a wireless connection.

In the rapid traverse, the motor generators 234 of the auxiliary pistons 200*a*, 200*b*, 200*c* are operated as motors. The second piston chamber 214 of the auxiliary pistons are thus pressurized so that the press surfaces 220 of the auxiliary pistons 200*a*, 200*b*, 200*c* are pushed upward. In cases where the press surfaces 120 of the upper piston 100 are thereby also pressed upward, the motor generator 134 of the upper piston can be operated as a generator and current can be fed into the DC bus 320 via the controller 140.

LIST OF REFERENCE SIGNS

10 Electro-hydrostatic actuator system
50 Line of symmetry
100 Upper piston
110 Cylinder of the upper piston
112 First piston chamber of the upper piston
114 Second piston chamber of the upper piston

116 Piston of the upper piston
118 Piston rod of the upper piston
120 Press surface of the upper piston
130 First electro-hydrostatic actuator
132 Hydraulic pump/motor unit of the upper piston
134 (Servo) motor generator of the upper piston
140 Controller of the upper piston
200*a*, 200*b*, 200*c* Auxiliary piston
210 Cylinder of the auxiliary piston
212 First piston chamber of the auxiliary piston
214 Second piston chamber of the auxiliary piston
216 Piston of the auxiliary piston
218 Piston rod of the auxiliary piston
220 Press surface of the auxiliary piston
222 Thickness of the press surface
224 Resting distance (offset) of the press surface
230 Second electro-hydrostatic actuator
232 Hydraulic pump/motor unit of the auxiliary piston
234 (Servo) motor generator of the auxiliary piston
240 Controller of the auxiliary piston
310 Central power supply
320 Electrical supply line, DC bus
350 Central control unit
360 Control bus (also wireless)
400 Mold
410 Pressed material, powder

The invention claimed is:

1. An electro-hydrostatic actuator system for a press drive, comprising:

an upper piston having a press surface acting from a first direction, wherein the press surface of the upper piston is actuated via a piston rod in a hydraulic cylinder of the upper piston and traverses a first distance in a press run, at least two auxiliary pistons, each auxiliary piston having a press surface acting from a second direction opposite the first direction, wherein the press surface of each auxiliary piston is actuated via a piston rod in a hydraulic cylinder of the auxiliary piston and traverses a second distance in the press run, a first electro-hydrostatic actuator operable to drive the upper piston, comprising a first pump and a first motor generator which is controlled by a first controller, and a second electro-hydrostatic actuator operable to drive at least one of the at least two auxiliary pistons, comprising a second pump and a second motor generator which is controlled by a second controller, wherein in the press run, the second motor generator of the second electro-hydrostatic actuator is operated as a generator, and wherein at least one of the press surfaces of the auxiliary pistons has a different thickness than another press surface of the auxiliary pistons.

2. The actuator system according to claim 1, wherein the second distance of the second press surface is a function of the first distance of the first press surface and the second distance in the first direction is shorter than the first distance.

3. The actuator system according to claim 1, wherein at least one of the press surfaces has a different resting distance than another press surface of the auxiliary pistons.

4. The actuator system according to claim 1, wherein the system comprises a plurality of upper pistons.

5. The actuator system according to claim 4, wherein each of the plurality of upper pistons comprises an electro-hydrostatic actuator.

6. The actuator system according to claim 1, wherein the first controller, which is assigned to the first motor generator, has a first control characteristic, and the second controller, which is assigned to the second motor generator, has a second control characteristic.

7. The actuator system according to claim 6, wherein the first control characteristic and/or the second control characteristic is described linearly, polynomially or by supporting points.

8. The actuator system according to claim 6, wherein the first control characteristic and/or the second control characteristic is determined by a central control unit.

9. The actuator system according to claim 1, further comprising an electrical supply line connected to the first controller and the second controller, wherein the second controller feeds current into the supply line in the press run.

10. The actuator system according to claim 1, wherein the system includes a rapid traverse, wherein the second motor generator of the second electro-hydrostatic actuator is operated as a motor.

11. An electro-hydrostatic actuator system for a press drive, comprising:

an upper piston having a press surface acting from a first direction, wherein the press surface of the upper piston is actuated via a piston rod in a hydraulic cylinder of the upper piston and traverses a first distance in a press run, at least two auxiliary pistons, each auxiliary piston having a press surface acting from a second direction opposite the first direction, wherein the press surface of each auxiliary piston is actuated via a piston rod in a hydraulic cylinder of the auxiliary piston and traverses a second distance in the press run, a first electro-hydrostatic actuator operable to drive the upper piston, comprising a first pump and a first motor generator which is controlled by a first controller, and a second electro-hydrostatic actuator operable to drive at least one of the at least two auxiliary pistons, comprising a second pump and a second motor generator which is controlled by a second controller, wherein in the press run, the second motor generator of the second electro-hydrostatic actuator is operated as a generator, and wherein at least one of the press surfaces has a different resting distance than another press surface of the auxiliary pistons.

12. The actuator system according to claim 11, wherein the second distance of the second press surface is a function of the first distance of the first press surface and the second distance in the first direction is shorter than the first distance.

13. The actuator system according to claim 11, wherein at least one of the press surfaces of the auxiliary pistons has a different thickness than another press surface.

14. The actuator system according to claim 11, wherein the system comprises a plurality of upper pistons.

15. The actuator system according to claim 14, wherein each of the plurality of upper pistons comprises an electro-hydrostatic actuator.

16. The actuator system according to claim 11, wherein the first controller, which is assigned to the first motor generator, has a first control characteristic, and the second controller, which is assigned to the second motor generator, has a second control characteristic.

17. The actuator system according to claim 16, wherein the first control characteristic and/or the second control characteristic is described linearly, polynomially or by supporting points.

18. The actuator system according to claim 16, wherein the first control characteristic and/or the second control characteristic is determined by a central control unit.

19. The actuator system according to claim 11, further comprising an electrical supply line connected to the first controller and the second controller, wherein the second controller feeds current into the supply line in the press run.

20. The actuator system according to claim 11, wherein the system includes a rapid traverse, wherein the second motor generator of the second electro-hydrostatic actuator is operated as a motor.

* * * * *